US006511578B2

(12) United States Patent
Dorn et al.

(10) Patent No.: US 6,511,578 B2
(45) **Date of Patent: *Jan. 28, 2003**

(54) BLEACHING AND DELIGNIFYING CELLULOSIC PULP USING CAROATE/CARO'S ACID SOLUTION

(75) Inventors: Maximilian Dorn, Pullach (DE); Michael Gnann, Grosshesselohe (DE); Sven Gutewort, München (DE); Werner Sebb, Geretsried (DE)

(73) Assignee: Peroxid-Chemie GmbH & Co. KG, Pullach (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/381,288

(22) PCT Filed: Mar. 19, 1998

(86) PCT No.: PCT/EP98/01622

§ 371 (c)(1),
(2), (4) Date: Sep. 21, 1999

(87) PCT Pub. No.: WO98/42911

PCT Pub. Date: Oct. 1, 1998

(65) Prior Publication Data

US 2002/0117276 A1 Aug. 29, 2002

(30) Foreign Application Priority Data

Mar. 21, 1997 (DE) ..... 197 11 929
Jan. 27, 1998 (DE) ..... 198 03 001

(51) Int. Cl.[7] ..... D21C 9/10; D21C 9/16

(52) U.S. Cl. ..... 162/29; 162/30.11; 162/50; 162/76; 162/82; 205/690; 423/513

(58) Field of Search ..... 162/76, 90, 29, 162/30.11, 50; 204/82; 423/513; 205/690

(56) References Cited

U.S. PATENT DOCUMENTS

| | | | | |
|---|---|---|---|---|
| 4,049,786 | A | 9/1977 | Chiang | 423/513 |
| 4,144,144 | A | 3/1979 | Radimer et al. | 204/82 |
| 4,756,800 | A | 7/1988 | Springer et al. | 162/64 |
| 5,366,593 | A | 11/1994 | Lee et al. | 162/72 |

FOREIGN PATENT DOCUMENTS

| | | |
|---|---|---|
| EP | 0 415 149 | 8/1990 |
| WO | 94/05851 | 3/1994 |

OTHER PUBLICATIONS

Amini et al., Tappi Journal, "On–site peracids: Tools for bleacing strategies to meet the cluster rule and considerations on selecting among them", vol. 78, No. 10, Oct. 1995, pp. 121–133.

*Primary Examiner*—Steve Alvo
(74) *Attorney, Agent, or Firm*—Arent Fox Kintner Plotkin & Kahn PLLC

(57) ABSTRACT

The invention relates to a method of bleaching and/or delignifying cellulose, in which (a) a sodium hydroxide solution and a peroxydisulphate solution are first of all produced by electrolysis of a sulphate, (b) the peroxydisulphate solution is converted by hydrolysis into a Caro's acid/caroate solution, (c) said Caro's acid/caroate solution is left to cool and (d) used immediately as a bleaching solution for bleaching and/or delignifying cellulose, the Caro's acid/caroate solution becoming neutralised upon introduction into the bleaching solution.

8 Claims, No Drawings

BLEACHING AND DELIGNIFYING CELLULOSIC PULP USING CAROATE/CARO'S ACID SOLUTION

This invention relates to a method of bleaching and/or delignifying cellulose using Caro's acid/caroate solution.

The traditional method of bleaching wood pulp for paper is to use large quantities of chlorine. However, since chlorinated lignin ranks among the environmentally toxic polychlorinated aromatics, increasing efforts have been made to replace the bleaching agent chlorine with other bleaching agents. The use of chlorine dioxide/chlorate as bleaching agent marked the start of a successful new era. Continuing efforts, however, are focused on replacing chlorine dioxide/chlorate with yet other bleaching agents, and thus to obtain TCF (Total Chlorine Free) pulp.

Bleaching agents which have been used to manufacture chlorine-free paper include ozone, oxygen and hydrogen peroxide. However, all these bleaching agents have disadvantages, such as insufficient delignification, insufficient brightness of the bleached cellulose and/or cost-intensive and/or dangerous production methods.

The use of caroate/Caro's acid (peroxymonosulphuric acid, $H_2SO_5$) as a bleaching agent for the bleaching and delignification of cellulose has also been suggested, especially for the chlorine-free bleaching of fine paper required to have a brightness level of 89 on the ISO scale. A disadvantage of using caroate/Caro's acid as bleaching agent, however, is the tedious process required to obtain the pure salt as a crystalline product. Pure Caro's acid, moreover, is an extremely corrosive substance, which makes storage and transport difficult.

The U.S. Pat. No. 5,366,593 describes a method of bleaching lignocellulose-containing material, in which, as reactants, the oxygen donor monoperoxy-sulphate and a ketone are used to form a water-soluble dioxirane on-site, which then acts as a bleach. The direct use of caroate/Caro's acid is not considered.

The U.S. Pat. No. 4,144,144 describes the production of sodium peroxydisulphate in an electrolytic cell, where the current efficiency can be increased by a suitable choice of anolyte.

The EP-A-O 415 149 A2 describes a method of bleaching and delignifying lignocellulose materials using peroxymonosulphuric acid and/or salts thereof in combination with oxygen and/or a peroxide. The peroxymonosulphuric acid is used in the form of its salt, or is obtained by reacting hydrogen peroxide with concentrated sulphuric acid. A similar process, in which peroxymonosulphuric acid is produced by reacting hydrogen peroxide and sulphuric acid, is also described by B. Amini et al. in Tappi Journal, Vol. 78, No. 10 (1995), 121–133.

The U.S. Pat. No. 4,049,786 describes a method of producing peroxymonosulphate by rapid hydrolysis of a peroxydisulphate with concentrated sulphuric acid, where active oxygen loss during hydrolysis can be suppressed by a suitable choice of reaction temperature.

WO-A-94/05851 describes a method of bleaching lignocellulose-containing pulp using peroxydisulphate.

The object of this invention was thus to provide a method with which the beneficial bleaching and delignification effects of Caro's acid/caroate can be exploited and, at the same time, the difficulties connected with the production of pure Caro's acid/caroate overcome and the danger of corrosion in storage and transport devices avoided.

This object is established according to the invention by a method of bleaching and/or delignifying cellulose, especially paper, in which (a) a sodium hydroxide solution and a peroxydisulphate solution are first of all produced by electrolysis of a sulphate, (b) the peroxydisulphate solution is converted by hydrolysis into Caro's acid/caroate solution, (c) said Caro's acid/caroate solution is left to cool and (d) used immediately as a bleaching solution for bleaching and/or delignifying cellulose, especially paper, the Caro's acid/caroate solution becoming neutralised upon introduction into the bleaching solution.

The method of the invention allows the use of Caro's acid/caroate in the form of a solution, which means that the disadvantages connected with the pure crystalline product can be avoided. These disadvantages are, in particular, the tedious process required to obtain the pure salt in crystalline form, and the corrosive nature of Caro's acid.

It is an essential feature of the invention that Caro's acid/caroate solution can be produced either in, or in the immediate vicinity of a pulp or paper mill, so that long transport distances—which necessitate separating off the water from the solution and obtaining the product in pure form—can be avoided. Protracted storage or transport over long distances require that the water first be separated off to form pure Caro's acid/caroate because, on the one hand, the pure product is in itself more stable than a solution thereof, which means it can be stored for longer, and on the other hand, the proportion of water in the solution makes transport over long distances considerably more difficult and expensive.

Production of Caro's acid/caroate either in, or in the immediate vicinity of a pulp or paper mill is realized by first of all producing a sodium hydroxide solution and a peroxydisulphate solution, for example sodium peroxydisulphate, potassium peroxydisulphate and/or calcium peroxydisulphate, by electrolysis of a sulphate, for example sodium sulphate, potassium sulphate and/or calcium sulphate. The peroxydisulphate solution can then be converted by hydrolysis into Caro's acid/caroate solution. Whereas this production process can be carried out without any danger in the proximity of wood, cellulose or paper, the conventional production of caroate from oleum and 70% hydrogen peroxide is extremely risky, since any contact between the starting materials and wood, cellulose or paper will cause a fire. This is the reason why it was hitherto not possible to produce Caro's acid/caroate in the vicinity of a pulp or paper mill.

Another advantage of simultaneously producing a peroxydisulphate solution and a sodium hydroxide solution by means of electrolysis is that pulp and paper mills often have inexpensive electricity from hydroelectric power stations, and that waste sulphate from sulphate cellulose can be put to economic use. It is preferable if the proportion of waste sulphate from sulphate cellulose accounts for more than 5 wt. % of the total amount of sulphate used in step (a), especially preferable if it accounts for more than 50 wt. % and most preferable of all if it accounts for more than 90 wt. % thereof.

According to the invention, the peroxydisulphate solution produced by electrolysis is then converted by way of hydrolysis into Caro's acid/caroate solution. On cooling, this Caro's acid/caroate solution was found to be relatively stable. Through addition of $H_2O_2$ during hydrolysis, the decomposition of Caro's acid/caroate can be minimised further. According to the invention, the Caro's acid/caroate solution obtained is used immediately as a bleaching solution for bleaching and/or delignifying cellulose, especially paper. The Caro's acid/caroate solution can be introduced— for example by way of a direct pipeline or in form of a bulk transport—into the bleaching solution. It is thus unnecessary, according to the invention, to produce Caro's acid/caroate in crystalline form.

According to the invention, the Caro's acid/caroate solution is neutralised upon introduction into the bleaching solution. It is beneficial to neutralise the Caro's acid/caroate solution at this point in time because a pH <5 promotes the stability of Caro's acid/caroate solution. Another reason is that the heat of neutralisation is distributed in the bleaching solution, thus reducing decomposition of the caroate solution/ Caro's acid still further.

As already mentioned, it is essential to the invention that the method of the invention can be carried out either in, or in the immediate vicinity of a pulp or paper mill. An added advantage of such an arrangement is that large paper mills usually already have a chlorine-alkali electrolysis facility, which can be modified to meet the requirements of a peroxydisulphate electrolysis. Furthermore, during the kraft process, for example, some 5 to 20 kg of sodium sulphate are added per tonne of paper. Before being supplied to the pulping process, this sodium sulphate can be used in the peroxydisulphate electrolysis. The sulphate, which is recovered after the bleaching process, is used subsequently in the pulping process. In this way, the sodium sulphate required anyway for the pulping process is first used for the bleaching process of the invention, after which it is recovered. The recovered sodium sulphate is sufficiently pure to be used subsequently in the pulping process.

Another advantage of the method of the invention is that it does not require the use of additional chemicals, so that there are no attendant problems with respect to disposal or environmental compatibility.

A preferred feature of the invention is the use of the sodium hydroxide solution produced by electrolysis to neutralise the Caro's acid/caroate solution in the bleaching solution.

It is furthermore preferable to use a membrane cell or a diaphragm cell—of the type described, for example, in Ullmann, Vol. 19, page 216—for the electrolysis.

It is preferable if the hydrolysis of the peroxydisulphate solution, during which a Caro's acid/caroate solution is formed, is conducted at 50 to 90° C., and especially preferable if it is conducted at 60 to 80° C. for 30 to 60 minutes, preferably 30 to 40 minutes. For the hydrolysis, it is preferable to use 1 to 4 N sulphuric acid. After hydrolysis, the Caro's acid/caroate solution, which preferably has a pH of <5, is allowed to cool to 0° C. to 50° C., preferably to 10° C. to 30° C.

The sulphate formed during the bleaching and/or delignification of cellulose, especially paper, can be recovered and supplied, for example, to a sulphate pulping process. The invention provides for the use of any suitable sulphate for electrolysis, preference being given to sodium sulphate, potassium sulphate and/or calcium sulphate.

With the method of the invention, cellulose, especially paper, can be obtained with a high level of brightness, measuring 89 on the ISO whiteness scale. A preferred bleaching sequence is, for example:

O—Q—P——X—P*, where O is oxygen, Q a complexing agent such as EDTA, P is $H_2O_2$ and X—P* is Caro's acid/caroate solution. However, other bleaching sequences may also be used.

The invention is explained in more detail by means of the following examples.

EXAMPLE 1

Production of Caro's Acid

Caro's acid was produced by hydrolysis from a solution of sodium peroxydisulphate. To this end, 2 mol/l (4N) SPS (sodium peroxydisulphate), ie, 476 g/l, and 0.25 M sulphuric acid (25.5 g/l) were heated to 70° C., with stirring, and kept at this temperature with continued stirring. The composition of the solution before and after hydrolysis is recorded in Table 1:

TABLE 1

| Time | SPS | $H_2SO_5$ | $H_2SO_4$ |
|---|---|---|---|
| Before heating | 476 g/l | 0 g/l | 25.5 g/l |
| After 3 hours | 59.9 g/l | 107 g/l | 210.7 g/l |

The yield of $H_2SO_5$ after 3 hours was 46.9%. After the solution had been cooled to room temperature, the decrease in caroate content over 20 hours was found to be only 2.8% relative (104 g $H_2SO_5$/l).

In another experiment, 2 mol/l (4N) NPS, ie, 476 g/l, and 2N sulphuric acid (98 g/l) were heated to 70° C., with stirring, and kept at this temperature with continued stirring. The composition of the solution before and after hydrolysis is recorded in Table 2:

TABLE 2

| Time | SPS | $H_2SO_5$ | $H_2SO_4$ |
|---|---|---|---|
| Before heating | 476 g/l | 0 g/l | 98 g/l |
| After 1 hour | 9.5 g/l | 162.3 g/l | 246 g/l |

The yield of $H_2SO_5$ after 1 hour was 71.2%. After the solution had been cooled to room temperature and partially neutralised to 0.34 N $H_2SO_4$, the caroate content only decreased by 1.3% relative.

EXAMPLE 2

Comparative bleaching and delignifying with PMPS (potassium monoperoxy-sulphate), hydrogen peroxide, and the caroate of example 1

Two Finnish pulp samples were analysed: Sample 5656 contains 68.5% water, a biocidal additive, and has the kappa number 20.3 (lignin). Sample 5657 contains 60.9% water, a biocidal additive, and has the kappa number 12.8 (lignin). Sample 5657 has already been pre-treated with oxygen. It is therefore brighter and contains less lignin.

Experiment a)

Pulp sample 5656 (not pre-bleached) was bleached with PMPS. The pulp density was 3%. For the experiment, 13% abs. dry $KHSO_5$ (29.6 g Curoxe®/100 g dry pulp) was used, which corresponds to 10% abs. dry $H_2SO_5$. The bleaching effect was visible immediately after addition.

After 30 minutes' treatment at 60° C. and pH 2.5, the sample was filtered under suction and washed with a large volume of water. After the sample had been dried carefully overnight at 30° C., brightness and weight were determined.

Experiment b)

Pulp sample 5656 (not pre-bleached) was bleached with hydrogen peroxide.

The pulp density was 3%. For the experiment, 2.9% abs. dry $H_2O_2$ was used. This amount has the same active oxygen content (corresponds to 1.4% abs. dry AO) as the 10% abs. dry $H_2SO_5$ (experiment a).

The pulp density was 3%. For the experiment, 10% abs. dry $H_2SO_5$ was used. The active oxygen content in this amount corresponds to 1.4% abs. dry AO.

After 30 minutes' treatment at 60° C. and pH 1.5, the sample was filtered under suction and washed with a large volume of water. After the sample had been dried carefully overnight at 30° C., brightness and weight were determined.

Results of Bleaching Experiments a) to f)

| Experiment | Sample | Abs. dry | AO | Pulp density | Degree of brightening | Kappa |
|---|---|---|---|---|---|---|
| a) | 5656 | 29.6% PMPS | 1.4% | 3% | +9.2% | 18.4 = −12.2% |
| b) | 5656 | 2.9% $H_2O_2$ | 1.4% | 3% | +5.2% | 0 |
| c) | 5656 | 10% $H_2SO_5$ | 1.4% | 3% | +7.6% | 18.9 = −9.6% |
| d) | 5657 | 29.6% PMPS | 1.4% | 3% | +14.3% | 12.9 = −12.4% |
| e) | 5657 | 2.9% $H_2O_2$ | 1.4% | 3% | +13.9% | 0 |
| f) | 5657 | 10% $H_2SO_5$ | 1.4% | 3% | +13.9% | 11.3 = −12.4% |

After 30 minutes' treatment at 60° C. and pH 6, the sample was filtered under suction and washed with a large volume of water. After the sample had been dried carefully overnight at 30° C., brightness and weight were determined.

Experiment c)

Pulp sample 5656 (not pre-bleached) was bleached with a solution of 116.4 g $H_2SO_5$ obtained according to Example 1.

The pulp density was 3%. For the experiment, 10% abs. dry $H_2SO_5$ was used. The active oxygen content in this amount corresponds to 1.4% abs. dry AO.

After 30 minutes' treatment at 60° C. and pH 1.5, the sample was filtered under suction and washed with a large volume of water. After the sample had been dried carefully overnight at 30° C., brightness and weight were determined.

Experiment d)

Pulp sample 5657 (not pre-bleached) was bleached with PMPS.

The pulp density was 3%. For the experiment, 13.3% abs. dry $KHSO_5$ (29.6 g Curox®/100 g dry pulp) was used, which corresponds to 10% abs. dry $H_2SO_5$.

After 30 minutes' treatment at 60° C. and pH 2.5, the sample was filtered under suction and washed with a large volume of water. After the sample had been dried carefully overnight at 30° C., brightness and weight were determined.

Experiment e)

Pulp sample 5657 (pre-bleached) was bleached with hydrogen peroxide.

The pulp density was 3%. For the experiment, 2.9% abs. dry $H_2O_2$ were used. This amount has the same active oxygen content (corresponds to 1.4% abs. dry AO) as the 10% abs. dry $H_2SO_5$.

After 30 minutes' treatment at 60° C. and pH 6, the sample was filtered under suction and washed with a large volume of water. After the sample had been dried carefully overnight at 30° C., brightness and weight were determined.

Experiment f)

Sample 5657 (not pre-bleached) was bleached with a solution of 116.4 g $H_2SO_5$ obtained according to example 1.

What is claimed is:

1. A method of bleaching and/or delignifying cellulosic pulp, comprising:

(a) first producing a sodium hydroxide solution and a peroxydisulphate solution by electrolysis of a sulphate, (b) converting the peroxydisulphate solution by hydrolysis into Caro's acid/caroate solution, (c) cooling the Caro's acid/caroate solution, and (d) providing a bleaching vessel containing cellulose and immediately adding the Caro's acid/caroate solution from step c) and sodium hydroxide produced in step a) to the bleaching vessel to form a bleaching solution, where upon adding the sodium hydroxide solution, the Caro's acid/caroate solution is neutralized, (e) bleaching and/or delignifying the cellulose with the bleaching solution, (f) removing the bleaching solution and recovering the sulphate, (g) Kraft pulping lignocellulosic material to produce a cellulosic pulp; and (h) adding the sulphate of step (f) to step (a) and repeating steps (a)–(g) a plurality of times.

2. The method of claim 1, with the proviso that no additional chemicals are added to steps (a)–(h).

3. The method of claim 1, characterized in that a membrane cell or a diaphragm cell is used for electrolysis in step (a).

4. A method according to claim 1, characterized in that the hydrolysis of the peroxydisulphate solution in step (b) is carried out at 50° C. to 90° C.

5. A method according to claim 1, characterized in that the hydrolysis of the peroxydisulphate solution in step (b) is carried out in 1 to 4 N sulphuric acid.

6. A method according to claim 1, characterized in that the Caro's acid/caroate solution is allowed to cool to 0° C. to 50° C.

7. A method according to claim 1, characterized in that sulphate formed during the bleaching and/or delignification of cellulose is recovered.

8. The method according to claim 1, wherein the sulphate of step (a) is selected from the group consisting of sodium sulphate, potassium sulphate, calcium sulphate and mixtures thereof.

* * * * *